US006477736B1

(12) United States Patent
Abernathy

(10) Patent No.: US 6,477,736 B1
(45) Date of Patent: Nov. 12, 2002

(54) GATE CLOSER APPARATUS

(76) Inventor: Lyle L. Abernathy, 36012 NE. 239th Ct., Yacolt, WA (US) 98675

( * ) Notice: Subject to any disclaimer, the term of this patent is extended or adjusted under 35 U.S.C. 154(b) by 94 days.

(21) Appl. No.: 09/670,675

(22) Filed: Sep. 27, 2000

Related U.S. Application Data

(60) Provisional application No. 60/156,500, filed on Sep. 28, 1999.

(51) Int. Cl.[7] ..... E05F 1/08
(52) U.S. Cl. ..... 16/72; 16/76
(58) Field of Search ..... 16/72, 75, 76, 16/401, 304, 305, 307, 312

(56) References Cited

U.S. PATENT DOCUMENTS

| | | | | | |
|---|---|---|---|---|---|
| 996,188 | A | * | 7/1911 | Nolte | 16/305 |
| 1,847,822 | A | * | 3/1932 | Denton | 16/76 |
| 2,025,238 | A | * | 12/1935 | Harter | 16/76 |
| 2,724,142 | A | * | 11/1955 | McNabb | 16/76 |
| 3,411,241 | A | * | 11/1968 | Harmon | 16/76 |
| 4,122,630 | A | * | 10/1978 | Parisien | 16/307 |
| 5,133,152 | A | * | 7/1992 | Grancagnolo | 16/312 |
| 5,649,339 | A | * | 7/1997 | Reed | 16/72 |

* cited by examiner

*Primary Examiner*—Anthony Knight
*Assistant Examiner*—Doug Hutton
(74) *Attorney, Agent, or Firm*—Olson & Olson

(57) ABSTRACT

A gate closer apparatus is provided in the form of a coil spring arranged to be installed onto a selected one of the corresponding, hinge-mounting, vertically extending gate post or gate frame members of a fence gate arrangement, the coil spring member fixedly mounted at one of its ends thereto and extends and encircles a portion of the selected vertical member. The opposite terminal end portion of the coil spring terminates in a laterally projecting end portion arranged for tensioned, abutting engagement with the other vertically extending member, either gate frame member or gate post member, so that pivoting movement of the gate member on its hinge members in the opening direction of the gate effects tensioning of the coil spring member by virtue of its fixed attachment at its one end and abutting engagement at its opposite, second end to the respective, corresponding gate and gate post members, the stored energy of the coil spring causing the gate to pivot on its hinges toward its closed position when hold on the gate is released and it is free to act under the influence of the coil spring.

7 Claims, 2 Drawing Sheets

GATE CLOSER APPARATUS

This application claims benefit under 35 U.S.C. 119(e) of the priority filing date of U.S. Provisional application 60/156,500, filed Sep. 28, 1999.

BACKGROUND OF THE INVENTION

This invention relates to gate closing devices, and more particularly to a gate closing device having a uniquely simplified construction for economical manufacture, ease of installation and durability in operation; the instant device being particularly well adapted for use in connection with large, heavy industrial-type gates.

As is well recognized, a wide variety of closing devices for gates, doors and the like have been provided heretofore in many different forms and arrangements, most all of which include rather complex structures which require a rather extensive manufacture and rather involved installation and mounting procedures. Moreover, it has been found that these disadvantages are only further compounded in closer constructs which are arranged for use in connection with very large and heavy gate structures as are typically found on ranches, farms and commercial sites where the gate openings must accommodate passage of large vehicles, animals and the like. The present invention provides an extremely simple closing apparatus structure suited for use on any gate structure from very lightweight units to the most heavy of commercial/industrial type.

SUMMARY OF THE INVENTION

In its basic concept, this invention provides an elongated coil spring particularly configured and arranged to be installed over one of the corresponding vertical members mounting the hinges of a fence gate, those being either the vertical frame member of the gate or the corresponding gate post set into the ground, the coil spring clamped into position thereon by a clamp member engaging one terminal end of the coil spring, the opposite terminal end of the coil spring providing a laterally projecting end portion arranged to extend into abutment with the associated, opposite hinge-mounting gate post member of the fence (or with the vertical frame member of a fence gate), whereby pivoting movement of the gate causes tensioning of the coil spring by virtue of its clamped engagement and abutment with the associated fence and gate members, the stored energy of the coil spring urging the gate member toward its closed position.

It is by virtue of the foregoing basic concept that the principal objective of this invention is achieved; namely the provision of a gate closer apparatus that overcomes the limitations and disadvantages associated with gate closing apparatus of the prior art.

Another object and advantage of this invention is the provision of a gate closer apparatus of the class described which is of simplified construction for economical manufacture and simplified installation.

Still another object and advantage of this invention is the provision of a gate closer apparatus of the class described which utilizes no moving parts per se and yet is fully adjustable by a user to achieve desired tensioning of the apparatus on a gate to accommodate various gate weights and sizes and closing speeds as may be desired or needed.

Yet another object and advantage of this invention is the provision of a gate closer apparatus of the class described which is particularly well adapted for use on large, heavy commercial and industrial type gates.

A further object and advantage of this invention is the provision of a gate closer apparatus of the class described which is arranged to be usable alternatively, as may be desired or needed, on either right or left hand opening gates and for inward or outward swing tension functions, as well as for tensioning a gate for both inward and outward swing and return to a central, closed disposition.

A still further object and advantage of this invention is to provide a gate closer apparatus of the class described which is installable on an erected fence gate or post without any disassembly of the components of the gate or post.

The foregoing and other objects and advantages of this invention will appear from the following detailed description, taken in connection with the accompanying drawings of a preferred embodiment.

DESCRIPTION OF THE PREFERRED EMBODIMENT

Figure 1:
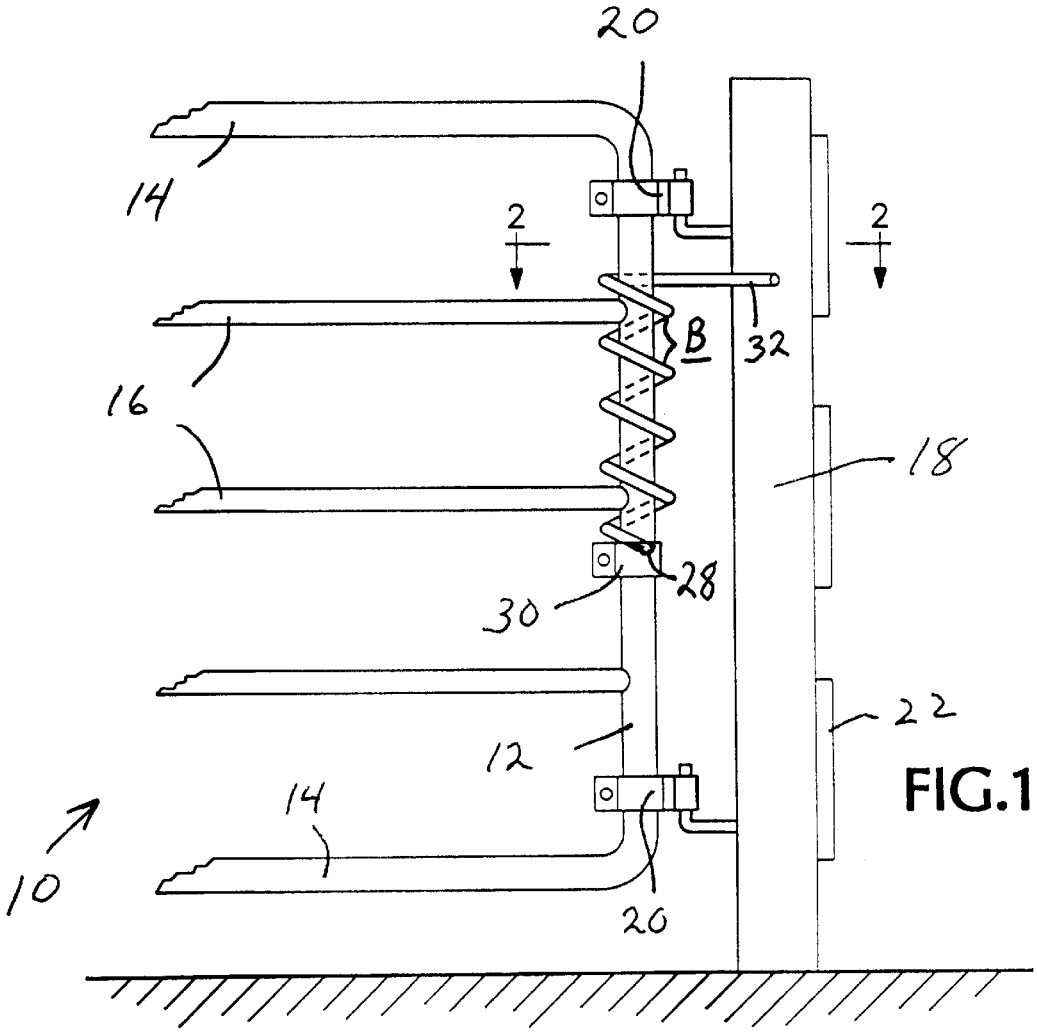
FIG. 1 is a fragmentary side elevation of a portion of a wide, heavy gate supported by hinges on a corner post of the fence arrangement with a gate closer apparatus embodying features of this invention installed in operative condition thereon.
Figure 2:
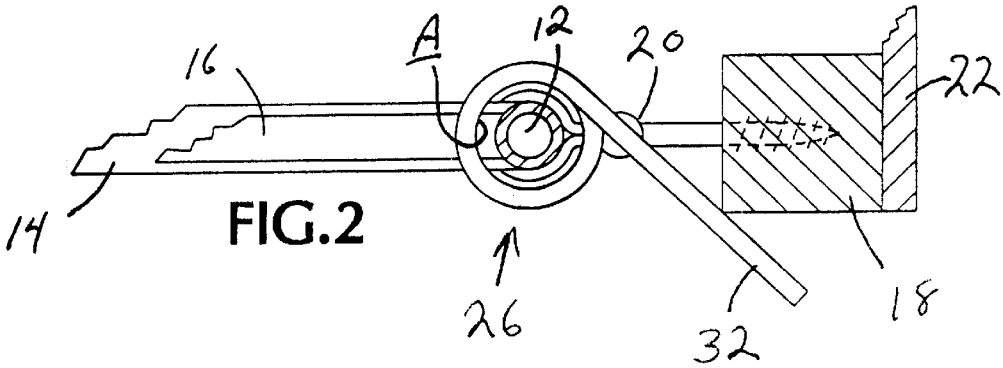
FIG. 2 is a fragmentary plan view, enlarged in scale, of the gate and gate closer apparatus of FIG. 1, taken along the line 2—2 in FIG. 1.
Figure 3:
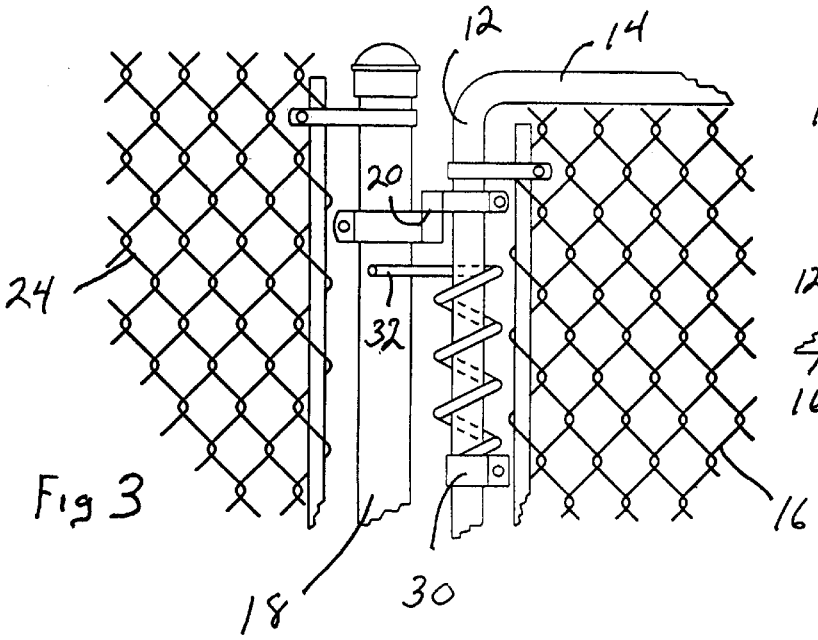
FIG. 3 is a fragmentary side elevation of a gate closer apparatus embodying the features of this invention adapted and installed on a lightweight, typical yard-type gate.

FIG. 1 illustrates a portion of a typical industrial-type fence and gate installation as is commonly found on farms, ranches and commercial sites where large, wide and heavy gates are provided in fence installations for passage of large vehicles, etc. therethrough. As is shown in the exemplary drawing, there is typically provided a gate member 10 comprising a pair of opposite vertical frame members 12, a pair of opposite horizontal frame members 14, and intermediate confinement members 16 (or confinement fabric means as at 24 in FIG. 3). The gate 10 is typically pivotally supported on a gate post 18 by hinge members 20 mounted on one of the gate vertical frame members 12 and the gate post 18, as is well known. The fence itself includes spanning confinement members, typically fence boards 22 (FIGS. 1, 2 and 4) or wire fabric 24 (FIG. 3) as is well known.

The simplified gate closer apparatus of the present invention is readily recognized and understood from even a cursory study of the drawings and comprises, in a basic form, an especially-configured coil spring member 26 uniquely arranged for installation onto the gate member 10 about and encircling its supporting vertical frame member 12, as seen in the various figures. One terminal end 28 of the spring member 26 is secured to the vertical gate frame member 12 by any suitable means such as by friction mounting clamp assembly 30 shown; the opposite terminal end 32 of the coil spring member 26 being configured to extend and project substantially horizontally from the gate for abutting engagement with a selected facing surface of the gate supporting gate post 18.

As will be evident to those skilled in the art, in the arrangement of FIG. 1, opening the gate member 10 (toward the viewer in FIG. 1 and toward the bottom of the page in FIG. 2) effects increasing tension of the coil spring by virtue of its fixed connection (28, 30) at its one end to the gate frame member 12 and its abutting engagement at its opposite terminal end 32 with the fixed, supporting gate post 18, and thereby storing energy to return the gate to its normally-closed condition when the gate is released and free to swing on its hinges.

With the foregoing basic concept of the invention thus understood, various structural requirements of the basic closer arrangement of this invention will now be addressed.

As will be evident to those skilled in the art, the coil spring itself may be formed of any suitable rod stock material in any overall finish length as may be determined to be desirable and suitable for the intended purpose. In the construction of the coil spring however, it is required that the finish unit is specifically configured with a minimum internal diametric axial opening A that is greater in cross section than the external diameter of the vertical member 12 of a gate onto which it is to be installed.

Further, the minimum spacing B between coils of the spring must be greater than the external diameter of the frame members 12, 14 or intermediate members 16, 24, whichever is larger, so that installation of the coil spring may be accomplished by simply rotating the spring onto and freely about the member 12 in substantially "threading" or "screwing" fashion, as can readily be understood in viewing the drawings. The mounting clamp assembly 30 may be fixedly attached to the terminal end 28 of the spring, or alternatively, be configured for releasable attachment thereto after installation of the coil spring onto the gate, if desired for convenience in installation or manufacture.

Figure 4:
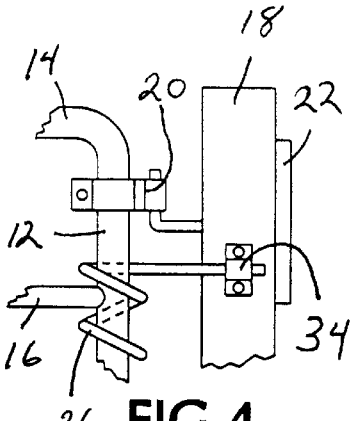
FIG. 4 is a fragmentary side elevation showing the gate closer of FIG. 1 further provided for opening and closing operation in both directions of gate swing, for returning the gate to a normally-closed condition.

As illustrated in FIG. 4 of the drawings, the opposite terminal end 32 of the coil spring may if desired be provided for sliding securement to a fence post 18, as by the loose-fit capture bracket 34 illustrated, to effect reverse-tensioning of the spring in both directions of gate travel in the case of a gate which is intended to be opened in either of its directions of swing. As will be apparent to those familiar with coil springs, the free, projecting terminal end of the spring will move in an axial direction as the coil expands or contracts in its opposite tensioning modes, and therefore a sliding securement means is preferred to eliminate undue stress imposed on the spring and the fence and gate structures during operation.

From the foregoing it will be apparent that the gate closer of the present invention, as embodied generally herein, is simply and easily installed by rotating the spring in "screwing fashion" onto the vertical member 12 of a gate until the spring has been effectively "threaded" loosely into desired position about the member 12. The terminal end 28 is then secured to the gate member 12 by suitable means such as clamp member 30 shown, with the opposite, projecting terminal end 32 of the coil in abutment with the supporting fence post 18 for tensioning of the coil spring during pivoting of the gate. It will also be apparent to those skilled in the art that tension may be adjusted by either pre-tensioning or reverse-tensioning of the coil prior to securement of its one end 28 onto the gate member 12, and desired spring strength may be varied and predetermined at manufacture for various end uses in connection with either heavy or light gates by selection of rod material type, gauge, finish coil length, etc. in order to achieve predetermined qualities.

Figure 5:
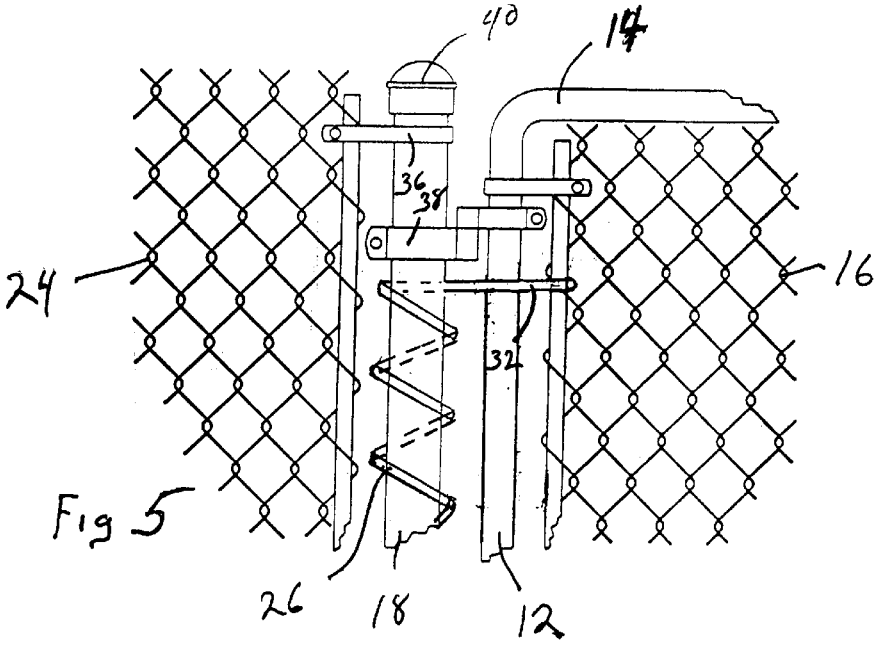
FIG. 5 is a fragmentary side elevation of a gate closer apparatus similar to that shown in FIG. 3 but illustrating the coil spring being configured for mounting on a gate post with the projecting end of the spring configured for abutting engagement with a hinged gate mounted on the gate post.

Also, it is to be understood that the simple reversal of the positioning of the coil spring apparatus on the gate elements is also contemplated, as is illustrated in FIG. 5 of the drawings. In this regard, the diametric opening A of the coil spring is configured to be greater in cross section than the external diameter of the gate post 18 of the fence, and the spacing B of the individual coils may be provided so as to be greater than the width of any bracket 36, 38 or top rail member (not shown) attached to the gate post member 18. In this manner, the spring member may be rotatably installed onto a gate post 18 as described previously in connection with the earlier embodiments of FIGS. 1 and 3, or alternatively, the spring may simply be slid down over the gate post member and clamped into place prior to the installation of the fabric brackets 36, hinge brackets 38 and post cap member 40. Final adjustment can then be made once the gate and fence assembly is completed, as by loosening the spring clamp assembly 30 (not shown in FIG. 5) and twisting the spring until the projecting end 32 is in desired tensioned abutment with the closed gate 10, at which point the clamp assembly 30 is then re-tightened to maintain the set tension. The operation of the gate closer apparatus so arranged follows similarly that previously described in connection with the spring installation shown in FIGS. 1–4.

It will be apparent to those skilled in the art that various changes, other than those specifically described hereinbefore, may be made in the size, shape, type, number and arrangement of parts without departing from the spirit of this invention and the scope of the appended claims.

Having thus described my invention and the manner in which it may be used, I claim:

1. A gate closer apparatus for use with a swinging fence gate having a vertically extending gate frame member supported on a vertically extending gate post member by hinge members interengaging the gate post member and the vertically extending gate frame member, the gate closer apparatus comprising:

a) a coil spring member having a central axial opening therethrough configured with an internal dimension greater in cross section than the external cross section of one of said vertically extending gate post member and vertically extending fence gate frame member for free reception of said one vertically extending member therethrough, the coils of said coil spring member being spaced apart a distance at least as great as the external cross section of said one of said vertically extending members to enable installation of the coil spring member on said one vertically extending member by placing the vertically extending member between the adjacent coils at one end of the coil spring member and rotating the latter to thread it onto the vertically extending member, b) the coil spring member having a first end portion configured for engaging said vertically extending fence gate frame member and a second end portion configured for engaging said gate post member, c) whereby pivotal movement of the fence gate in an opening direction effects rotational, winding movement of the coil spring member that increases stored energy in said spring member, which stored energy then moves the fence gate on its hinge members toward its closed position when the fence gate is released from an open position.

2. The gate closer apparatus of claim 1 including coil spring mounting means comprising a clamp bracket member engaging said first terminal end portion of the coil spring member, the clamp bracket member configured for releasable clamping securement to said one vertically extending member.

3. The gate closer apparatus of claim 1 including securement means for interengaging said second terminal end portion of the coil spring member and the other of said vertically extending members for winding tensioning of the coil spring member in both, opposite directions of rotational winding movement of the coil spring member.

4. The gate closer apparatus of claim 1 wherein said one vertically extending member is said vertically extending gate frame member and the fence gate includes at least one horizontal member fixedly mounted on and extending from the vertically-extending gate frame member of the fence gate, and said coil spring member is further configured with a spacing between the coils of the coil spring member that is greater than the external dimension of the horizontal member, whereby the coil spring member is installed into encircling condition extending along a portion of the vertical gate frame member of a fence gate by rotating the coil spring member about the vertically extending gate frame member with the fixedly mounted horizontal member extending between adjacent coils of the coil spring as the latter is rotated.

5. A gate closer apparatus for use with a swinging fence gate having a vertically extending gate frame member supported on an adjacent, vertically extending gate post by interengaging hinge members, the gate closer apparatus comprising:

a) a coil spring member having a central axial opening therethrough configured with an internal diameter greater in cross section than the external dimension of an upstanding gate post for free reception of said gate post therethrough,the coils of said coil spring member being spaced apart a distance at least as great as the external cross section of said gate post to enable installation of the coil spring member on the gate post by placing the gate post between adjacent coils at one end of the coil spring member and rotating the latter to thread it onto the gate post, and b) coil spring mounting means for engaging a first terminal end portion of said coil spring member and frictionally engaging said upstanding gate post and securing said terminal end fixedly thereto with the coil spring extending along and encircling a portion of the upstanding gate post, the coil spring member having a second, opposite terminal end portion configured to extend substantially perpendicularly to the line of the central axial opening therethrough, said second terminal end portion further configured for abutting engagement with the swinging fence gate pivotally supported on the upstanding gate post by said hinge members, c) whereby pivotal movement of the swinging fence gate in its opening direction effects rotational, winding movement of the coil spring member that increases stored energy in said coil spring member, which stored energy then moves the fence gate on its hinge members toward its closed position when the swinging fence gate is released from an open position.

6. A gate closer apparatus for use with a swinging fence gate having a vertically extending gate frame member supported on an adjacent, vertically extending gate post by interengaging hinge members, the gate closer apparatus comprising:

a) a coil spring member having a central axial opening therethrough configured with an internal dimension greater in cross section than the cross sectional dimension of said vertically extending gate frame member for free reception of said gate frame member therethrough, the coils of said coil spring member being spaced apart a distance at least as great as the external cross section of said vertically extending gate frame member to enable installation of the coil spring member on said gate frame member by placing the latter between adjacent coils at one end of the coil spring member and rotating the latter to thread it onto the gate frame member, b) coil spring mounting means for engaging a first terminal end portion of said coil spring member and frictionally engaging said vertically extending gate frame member and securing said terminal end portion fixedly thereto with the coil spring member extending along and encircling a portion of the gate frame member, the coil spring member having a second, opposite terminal end portion configured to extend substantially perpendicularly to the line of the central axial opening therethrough, said second terminal end portion further configured for abutting engagement with said upstanding gate post, c) whereby pivotal movement of the swinging fence gate in its opening direction effects rotational, winding movement of the coil spring member that increases stored energy in said coil spring member, which stored energy then moves the fence gate on its hinge members toward its closed position when the swinging fence gate is released from its open position.

7. A gate closer apparatus for use with a swinging fence gate having a horizontally extending gate frame member mounted on and extending from a vertically extending gate frame member supported on an adjacent, vertically extending gate post by interengaging hinge members, the gate closer apparatus comprising:

a) a coil spring member having a central axial opening therethrough configured with an internal dimension greater in cross section than the cross sectional dimension of said vertically extending gate frame member for free reception of said gate frame member therethrough, the coils of said coil spring member being spaced apart a distance at least as great as the external cross section of said horizontally extending gate frame member to enable installation of the coil spring member on said vertically extending gate frame member by placing the horizontally extending gate frame member between adjacent coils at one end of the coil spring member and rotating the latter to thread it onto the vertically extending gate frame member, b) coil spring mounting means for engaging a first terminal end portion of said coil spring member and frictionally engaging said vertically extending gate frame member and securing said terminal end portion fixedly thereto with the coil spring member extending along and encircling a portion of the vertically extending gate frame member, the coil spring member having a second, opposite terminal end portion configured to extend substantially perpendicularly to the line of the central axial opening therethrough, said second terminal end portion further configured for abutting engagement with said upstanding gate post, c) whereby pivotal movement of the swinging fence gate in its opening direction effects rotational, winding movement of the coil spring member that increases stored energy in said coil spring member, which stored energy then moves the fence gate on its hinge members toward its closed position when the swinging fence gate is released from its open position.

* * * * *